US005867010A

United States Patent [19]

Hinedi et al.

[11] Patent Number: 5,867,010

[45] Date of Patent: Feb. 2, 1999

[54] CIRCUIT AND METHOD FOR VOLTAGE LEVEL TRANSLATION UTILIZING A BIAS GENERATOR

[75] Inventors: Fahd Hinedi; Moises Cases; Satyajit Dutta, all of Austin, Tex.; Robert Heath Dennard, New Rochelle, N.Y.

[73] Assignee: International Business Machines Corporation, Armonk, N.Y.

[21] Appl. No.: 870,285

[22] Filed: Jun. 6, 1997

[51] Int. Cl.[6] ..... G05F 1/56

[52] U.S. Cl. ..... 323/282

[58] Field of Search ..... 323/266, 273, 323/282; 327/108, 365, 425, 478, 535, 538, 539, 543; 326/80, 81

[56] References Cited

U.S. PATENT DOCUMENTS

| | | | |
|---|---|---|---|
| 5,075,572 | 12/1991 | Poteet et al. | 307/350 |
| 5,300,835 | 4/1994 | Assar et al. | 307/475 |
| 5,319,259 | 6/1994 | Merrill | 307/443 |
| 5,410,267 | 4/1995 | Haycock et al. | 326/81 |
| 5,440,244 | 8/1995 | Richter et al. | 326/37 |
| 5,489,862 | 2/1996 | Risinger et al. | 327/108 |
| 5,521,530 | 5/1996 | Yao et al. | 326/80 |
| 5,521,531 | 5/1996 | Okuzumi | 326/81 |
| 5,528,447 | 6/1996 | McManus et al. | 361/91 |
| 5,537,070 | 7/1996 | Risinger | 327/170 |
| 5,541,534 | 7/1996 | Cao et al. | 326/81 |
| 5,546,019 | 8/1996 | Liao | 326/81 |
| 5,574,389 | 11/1996 | Chu | 326/81 |
| 5,663,663 | 9/1997 | Cao et al. | 326/81 |

*Primary Examiner*—Matthew Nguyen
*Attorney, Agent, or Firm*—Sawyer & Associates; Casimer K. Salys

[57] ABSTRACT

Circuit and method aspects for translating acceptable voltage levels from an external device to acceptable voltage levels of an internal device are provided. These aspects include coupling an input receiver between the external device and the internal device, the input receiver including a clamp device, and coupling a bias generator to the input receiver at the clamp device, wherein the bias generator ensures proper translation of a high level input signal from the external device by the input receiver. The bias generator further ensures that a predetermined maximum device voltage of the clamp device is not exceeded.

20 Claims, 2 Drawing Sheets

CIRCUIT AND METHOD FOR VOLTAGE LEVEL TRANSLATION UTILIZING A BIAS GENERATOR

FIELD OF THE INVENTION

The present invention relates generally to input/output interfaces of processors and more particularly, to voltage level conversion to support input/output interfaces.

BACKGROUND OF THE INVENTION

As the development of computer systems proceeds, increases to the processing speed are continually desired. Typically, reduction in device geometries of system components is sought to help increase speed and density. Associated with the reduction in device size is a reduction in power supply voltage requirements. For example, it is possible for normal operating voltages in the processor to range between 0 volts (V) and 1.8 V.

Further, advances in processor technology is occurring at a much faster pace than in typical input/output (I/O) devices. Off chip receivers (OCRs) of processors interface with many different external devices, such as ASICs (application specific integrated circuits), SRAMs (static random access memories), etc. These external devices tend to be designed in earlier technologies and thus use higher core voltages, which in turn results in their driving higher voltages. For example, normal operating voltages range between 0 V and 3.3 V The higher voltages driven by the external devices potentially damage FET (field effect transistor) devices in the input stage of the OCRs by violating the gate-source/drain voltage limitations of the processor technology.

For example, some fabrication techniques impose a relatively low predetermined limit on a maximum safe difference between a voltage level at a transistor's gate and a voltage level ar a source/drain region of the transistor. In such a situation, if the transistor's source/drain region has a voltage level that differs from the voltage level at the transistor's gate by more than the predetermined limit, then the transistor's gate oxide could be damaged in a manner that destroys the transistor's operability.

The OCR design therefore has to be voltage level compatible with these existing external support devices. Usually, this results in OCRs being designed for use with a higher power supply voltage than that of the core processor logic. Additional design challenges regarding thin gate oxide protection and circuit performance thus result. Accordingly, what is needed is improved thin gate oxide protection and circuit performance for OCRs, thereby providing improved design margins and device reliability.

SUMMARY OF THE INVENTION

The present invention provides a method and circuit aspects for translating acceptable voltage levels from an external device to acceptable voltage levels of an internal device. These aspects include coupling an input receiver between the external device and the internal device, the input receiver including a clamp device, and coupling a bias generator to the input receiver at the clamp device, wherein the bias generator ensures proper translation of a high level input signal from the external device by the input receiver. The bias generator further ensures that a predetermined maximum device voltage of the clamp device is not exceeded.

With the present invention, device damage due to process limitations (i.e., gate oxide damage) is prevented. Further, the present invention ensures that proper propagation of a high level input signal occurs through the input receiver by adjustment of the voltage applied at the clamp device through the bias generator. These and other advantages of the aspects of the present invention will be more fully understood in conjunction with the following detailed description and accompanying drawings.

DESCRIPTION OF THE INVENTION

The present invention relates to voltage level translation through an input receiver. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

Figure 1:
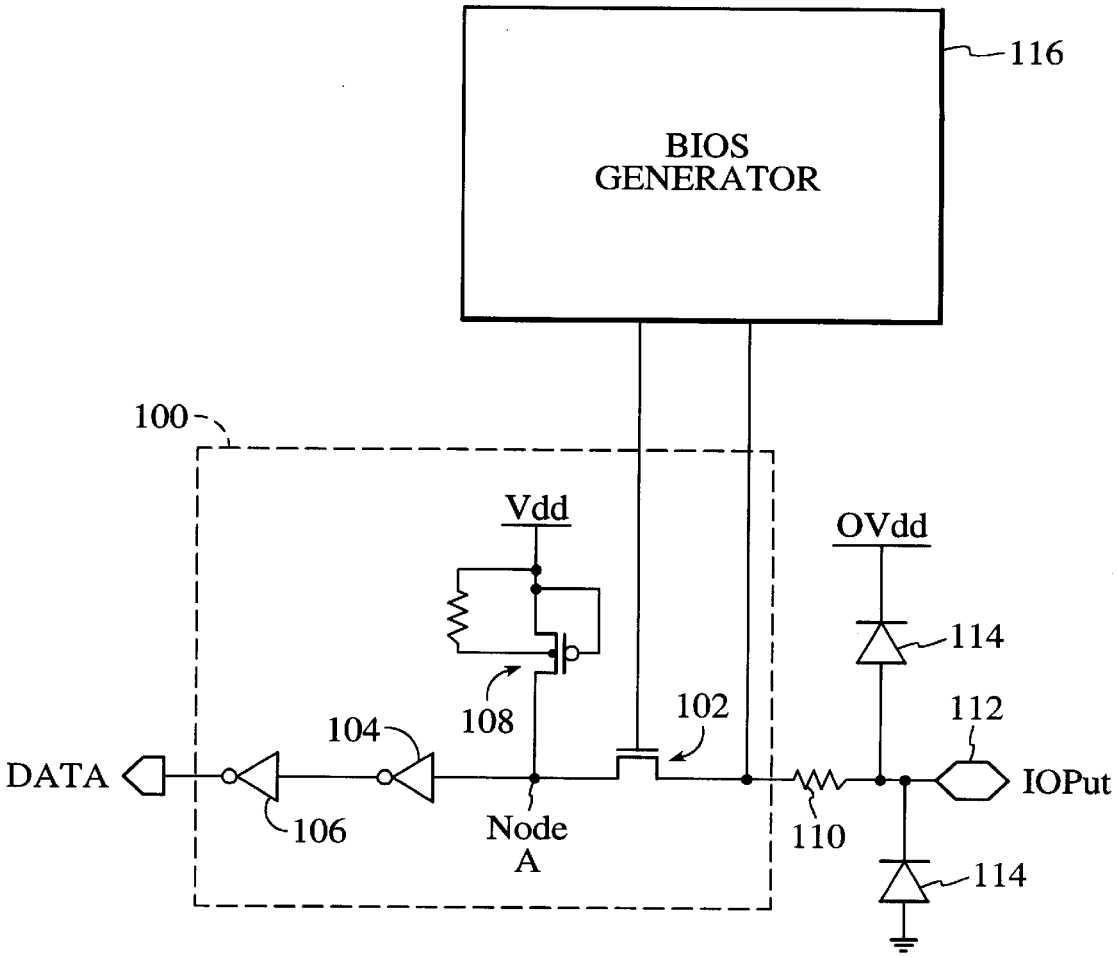
FIG. 1 illustrates a voltage level translation circuit including a bias generator in accordance with the present invention.

FIG. 1 illustrates a circuit for achieving voltage level interfacing in accordance with the present invention. For purposes of this discussion, a first supply voltage node Vdd has a voltage of approximately 1.8 V (±5%) relative to a reference voltage node GND (0V). A second supply voltage node OVdd has a voltage of approximately 3.3 V (±5%) relative to GND. Further, the transistors described herein suitably refer to metal oxide semiconductor field effect transistors (MOSFETs), and accordingly, are formed integrally within integrated circuitry. Suitably, each FET acts as a control device having a control node, i.e., a gate region, and first and second conducting nodes, i.e., source/drain regions. Each control device suitably conducts electrical current between its two conducting nodes in response to a logic state of its control node, as is well understood by those skilled in the art. Source/drain regions of the n-type transistors discussed herein are n-type diffusions formed within a p-type substrate which is connected to GND, while source/drain regions of the p-type transistors are p-type diffusions formed within at least one n-type well which is connected to OVdd or Vdd, as indicated in the figures. Of course, the transistors discussed are formed with a channel width-tolength ratio which is substantially optimized in order to suitably account for various aspects of the specific process technology used for fabrication.

Referring to FIG. 1, an input receiver 100 includes a clamp device 102, e.g., an n-type FET with a 0 V threshold voltage (0-$V_t$), and input devices, e.g., two inverters 104 and 106, with the input of inverter 104 coupled to a source of the clamp device 102 and an output of inverter 104 coupled to an input of inverter 106. An output of inverter 106 suitably provides a data signal, DATA, and interfaces input receiver 100 with internal processor circuitry (not shown). Input receiver 100 further includes protective device 108, e.g., a p-type FET coupled at its drain to the source of clamp device 102, and coupled at its gate and source to Vdd, to act as a 'bleeder' device and remove any leakage current which could slowly charge Node A. Preferably, protective device 108 acts as a discharge path should the voltage level from clamp device 102 exceed approximately 2.5 V in order to avoid damaging input devices 104 and 106, as is well appreciated by those skilled in the art.

Input receiver 100 is coupled to a resistor 110 at a drain of clamp device 102. The resistor 110 suitably serves as an output impedance control device, as well as provides FET device protection, as is well understood to those skilled in the art. Resistor 110 couples clamp device 102 to an external signalling device via signal pad input, IOPUT, 112. Diode devices 114 are also coupled to signal input 110 to act as further protection.

In a preferred embodiment, the circuit of FIG. 1 further includes bias generator 116. Preferably, bias generator 116 is coupled to sense the signal input 112 and provide more efficient translation by the clamp device 102. In prior art circuits, clamp device 102 is typically coupled to a core voltage source at its gate, which in prior technologies was at least 2.5 V. With the reduction of device sizes, and correspondingly, a reduction in the core voltage level to 1.8 V, continuing to merely couple the clamp device 102 at its gate to a 1.8 V supply may result in the input device 104 not tripping when a high level signal is input at signal input 112. Further, merely maintaining the coupling to the prior art voltage source of at least 2.5 V would violate a maximum device voltage level of approximately 2.4 V tolerated by the input devices 104 and 106. Bias generator 116 is therefore included in accordance with the present invention to operate within device voltage level limitations, while ensuring proper signal triggering, as discussed in more detail with reference to FIG. 2.

Figure 2:
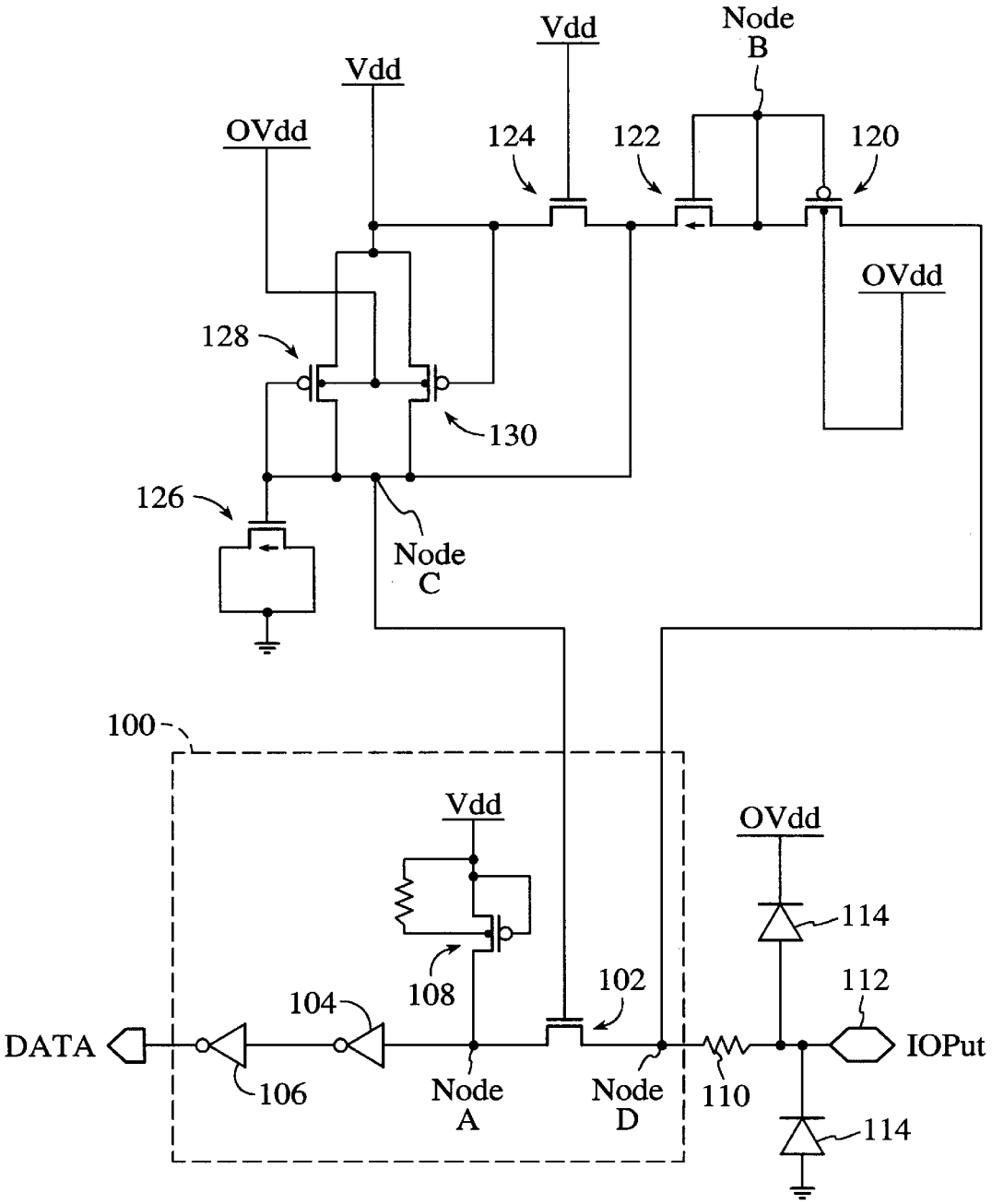
FIG. 2 illustrates a bias generator portion of the circuit of FIG. 1 in greater detail.

FIG. 2 illustrates a preferred circuit for bias generator 116. Suitably, a first transistor 120, e.g., a p-type FET, is coupled at its source to the drain of the clamp device 102 (at a node, Node D) and coupled at its gate and source to a drain and gate of a second transistor 122, e.g., an n-type FET, at a node, Node B. Preferably, the first transistor 120 acts as a source follower, as is well understood to those skilled in the art. Further included is a third transistor 124, e.g., an n-type FET, coupled at its gate and drain to Vdd and at its source to the source of the second transistor 122. The source of third transistor 124 is further coupled to the gate of clamp device 102. In addition, a fourth transistor 126, e.g., an n-type FET, acts as an additional storage capacitance and is coupled at its gate to the source of the third transistor 124 with its source and drain tied to GND. Further coupled to the gate of the fourth transistor 126 are a gate and drain of a fifth transistor 128, e.g., a p-type FET, and a drain of a sixth transistor 130, e.g., a p-type FET. The sources of the fifth and sixth transistors 128 and 130 are suitably coupled to Vdd, with the gate of the sixth transistor 130 also suitably coupled to Vdd.

During normal quiescent condition, the gate of the clamp device 102, i.e., Node C, is charged to approximately Vdd-$Vt_{124}$, (i.e., the threshold voltage of the third transistor 124), where the third transistor 124 is preferably a 0-Vt FET device. Thus, the voltage level at the gate of the clamp device 102 is approximately Vdd. When the signal input, IOPUT, is driven to "LOW" logic level, (e.g., 0 V) by an external device, first transistor 120 turns off, Node B floats and Node C is driven back to Vdd-$Vt_{124}$, which is approximately Vdd.

When the signal input, IOPUT, is driven to a "HIGH" logic level, i.e., beyond Vdd by an external device to approximately 3.3 V, the first transistor 120 suitably acts as a source follower, and thus Node B will try to reach $V_{NodeD}$-$Vt_{120}$Then, Node C tries to charge to $V_{NodeB}$-$Vt_{122}$. But, the circuit formed by the fourth, fifth, and sixth transistors 126, 128, and 130 turns on and clamps Node C to $V_{NodeB}$-$Vt_{122}$-$Vt_{130}$. Suitably, $Vt_{120}$ is approximately 0.4 V, while $Vt_{122}$ is approximately 0.4 V, and $Vt_{130}$ is approximately 0.4 V. Thus, Node C suitably is raised to about 2.2 V.

Through the present invention, the gate voltage of clamp device 102 ranges from 1.8 V to 2.2 V. The bias generator 116 suitably provides the proper bias voltage to the gate of the clamp device 102 to prevent any violation of gate stress voltage and to optimize circuit performance. Thus, proper translation of high and low level input signals is efficiently achieved without risk of device damage.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A circuit for translating acceptable voltage levels from an external device to acceptable voltage levels of an internal device, the circuit comprising:

an input receiver, the input receiver coupling the external device to the internal device, and including a clamp device; and a bias generator, the bias generator coupled to the clamp device (at a gate), and biasing the clamp device to ensure proper translation of a high level input signal from the external device by the input receiver.

2. The circuit of claim 1 wherein the clamp device further comprises a FET device and includes a gate, a source, and a drain.

3. The circuit of claim 2 wherein the FET device is an n-type FET device.

4. The circuit of claim 2 wherein the bias generator is coupled to the gate of the clamp device.

5. The circuit of claim 2 wherein the bias generator further comprises first, second, third, fourth, fifth and sixth FET devices.

6. The circuit of claim 5 wherein the first FET device is coupled to a drain of the clamp device and the fourth, fifth, and sixth FET devices are coupled to a gate of the clamp device.

7. The circuit of claim 2 wherein the input receiver further comprises at least one input device.

8. The circuit of claim 7 wherein an input of the at least one input device is coupled to a source of the clamp device and provides an output to the internal device.

9. The circuit of claim 8 wherein the at least one input device further comprises at least one inverter.

10. A voltage level translator comprising:

a signal input, the signal input receiving an external signal from an external device, the external signal having a maximum voltage level indicative of a high logic level;

a clamp device coupled to the signal input, the clamp device clamping the external signal to an internal signal; and a bias generator coupled to the clamp device, the bias generator being triggered when the external signal is received at the high logic level to ensure proper translation without exceeding a predetermined maximum device voltage of the clamp device.

11. The translator of claim 10 wherein the clamp device further comprises clamping with an n-type FET.

12. The translator of claim 11 wherein the n-type FET comprises a zero threshold voltage FET.

13. The translator of claim 11 wherein the bias generator is coupled to a gate of the n-type FET.

14. The translator of claim 10 wherein the maximum voltage level comprises approximately 3.3 V.

15. The translator of claim 10 wherein the predetermined maximum device voltage comprises approximately 2.4 V.

16. A method for translating acceptable voltage levels from an external device to acceptable voltage levels of an internal device, the method comprising:

coupling an input receiver between the external device and the internal device, the input receiver including a clamp device; and coupling a bias generator to the input receiver at the clamp device, wherein the bias generator ensures proper translation of a high level input signal from the external device by the input receiver.

17. The method of claim 16 wherein the clamp device further comprises a n-type field effect transistor, FET, device and includes a gate, a source, and a drain.

18. The method of claim 17 wherein coupling the bias generator further comprises coupling the bias generator to the gate of the clamp device.

19. The method of claim 17 wherein the bias generator further comprises first, second, third, fourth, fifth and sixth FET devices.

20. The method of claim 19 wherein coupling the bias generator further comprises coupling the first FET device to a drain of the clamp device and coupling the fourth, fifth, and sixth FET devices to a gate of the clamp device.

* * * * *